US007093551B2

(12) United States Patent
Saho et al.

(10) Patent No.: US 7,093,551 B2
(45) Date of Patent: Aug. 22, 2006

(54) FRESHWATER SUPPLY SYSTEM

(75) Inventors: Norihide Saho, Tsuchiura (JP); Hisashi Isogami, Ushiku (JP); Takashi Mizumori, Tomobe-machi (JP); Akira Mochizuki, Tomobe-machi (JP); Yoichi Imamura, Tomobe-machi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/939,343

(22) Filed: Sep. 14, 2004

(65) Prior Publication Data

US 2005/0066868 A1 Mar. 31, 2005

(30) Foreign Application Priority Data

Sep. 16, 2003 (JP) ..... 2003-322371

(51) Int. Cl.
*B63B 25/08* (2006.01)

(52) U.S. Cl. ..... 114/74 R; 114/125; 137/1; 405/52; 71/9

(58) Field of Classification Search ..... 114/74 R, 114/125; 405/32, 36, 52; 137/1; 71/9; 210/613, 210/620; 705/1, 37, 400
See application file for complete search history.

(56) References Cited

U.S. PATENT DOCUMENTS 3,286,675 A * 11/1966 Weber ..... 114/74 R
3,844,239 A * 10/1974 McLaughlin et al. ..... 114/74 R
4,335,977 A * 6/1982 Ihli ..... 405/32
4,735,524 A * 4/1988 Dunkers ..... 405/52
5,942,022 A * 8/1999 Bislev et al. ..... 71/9
6,125,778 A * 10/2000 Rodden ..... 114/74 R
6,161,561 A * 12/2000 Pratt et al. ..... 137/1

FOREIGN PATENT DOCUMENTS

JP 51-143283 12/1976
JP 60-209382 10/1985

* cited by examiner

*Primary Examiner*—Lars A. Olson
(74) *Attorney, Agent, or Firm*—Crowell & Moring LLP

(57) ABSTRACT

A freshwater supply system that stores fresh water transported by transport ships in storage devices and takes out the fresh water from the freshwater storage devices at need to use the same. The system comprises management device that puts management information together and sends and receives various information of countries for demand of the fresh water, analysis information of the fresh water, and various information of transportation device for transportation of the fresh water to the countries. Magnitudes of movements, prices, origins of movement, and destinations of movement of the fresh water are decided from the information from the management device.

9 Claims, 5 Drawing Sheets

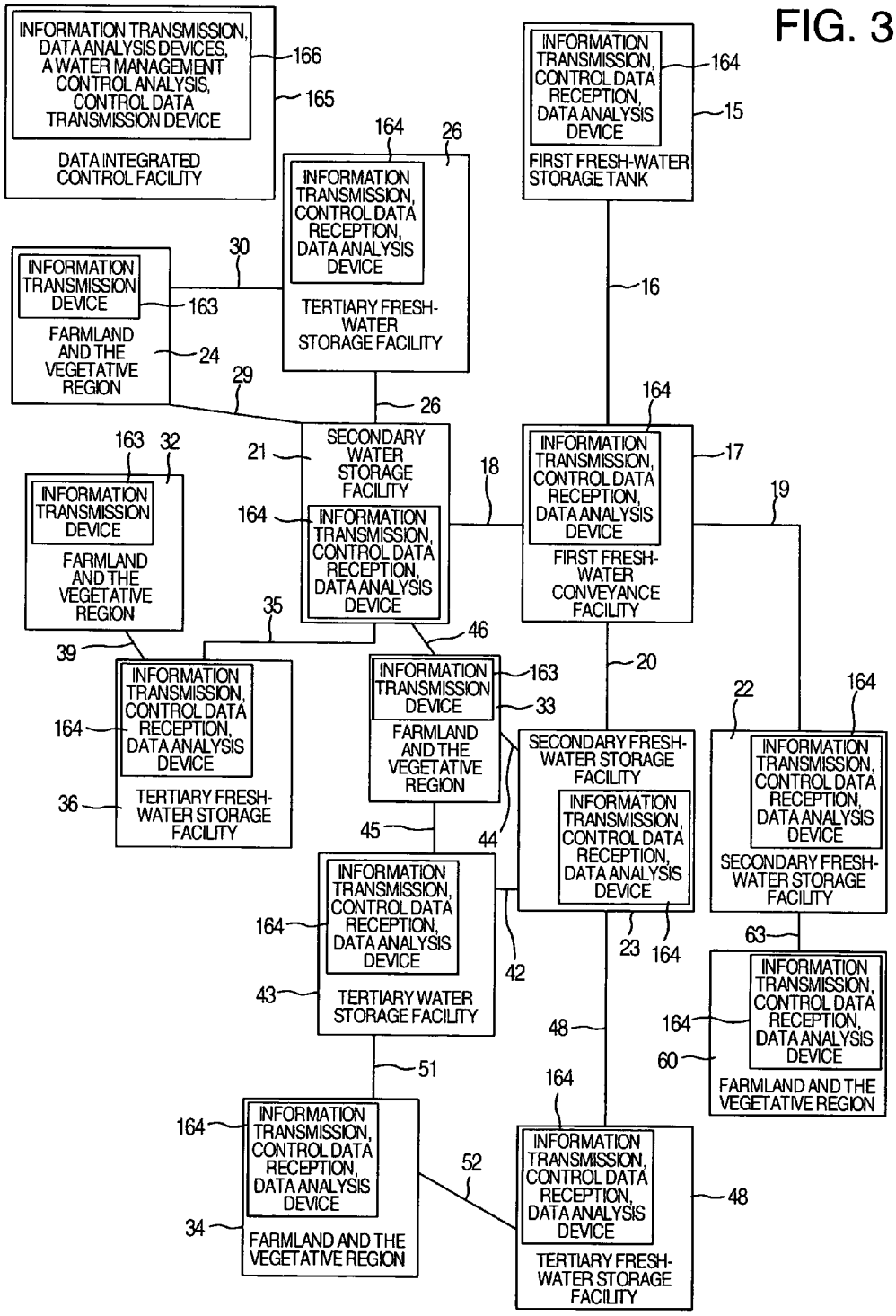
FIG. 3
INFORMATION TRANSMISSION, DATA ANALYSIS DEVICES, A WATER MANAGEMENT CONTROL ANALYSIS, CONTROL DATA TRANSMISSION DEVICE
DATA INTEGRATED CONTROL FACILITY
166
165
INFORMATION TRANSMISSION, CONTROL DATA RECEPTION, DATA ANALYSIS DEVICE
FIRST FRESH-WATER STORAGE TANK
164
15
164
26
INFORMATION TRANSMISSION, CONTROL DATA RECEPTION, DATA ANALYSIS DEVICE
TERTIARY FRESH-WATER STORAGE FACILITY
30
INFORMATION TRANSMISSION DEVICE
163
FARMLAND AND THE VEGETATIVE REGION
24
29
16
26
164
SECONDARY WATER STORAGE FACILITY
21
18
INFORMATION TRANSMISSION, CONTROL DATA RECEPTION, DATA ANALYSIS DEVICE
17
19
163
32
INFORMATION TRANSMISSION DEVICE
FARMLAND AND THE VEGETATIVE REGION
164
INFORMATION TRANSMISSION, CONTROL DATA RECEPTION, DATA ANALYSIS DEVICE
FIRST FRESH-WATER CONVEYANCE FACILITY
35
46
39
INFORMATION TRANSMISSION, CONTROL DATA RECEPTION, DATA ANALYSIS DEVICE
164
36
TERTIARY FRESH-WATER STORAGE FACILITY
INFORMATION TRANSMISSION DEVICE
163
33
FARMLAND AND THE VEGETATIVE REGION
20
SECONDARY FRESH-WATER STORAGE FACILITY
INFORMATION TRANSMISSION, CONTROL DATA RECEPTION, DATA ANALYSIS DEVICE
22
164
INFORMATION TRANSMISSION, CONTROL DATA RECEPTION, DATA ANALYSIS DEVICE
SECONDARY FRESH-WATER STORAGE FACILITY
45
44
INFORMATION TRANSMISSION, CONTROL DATA RECEPTION, DATA ANALYSIS DEVICE
164
TERTIARY WATER STORAGE FACILITY
43
42
23
164
63
INFORMATION TRANSMISSION, CONTROL DATA RECEPTION, DATA ANALYSIS DEVICE
164
60
FARMLAND AND THE VEGETATIVE REGION
48
51
164
INFORMATION TRANSMISSION, CONTROL DATA RECEPTION, DATA ANALYSIS DEVICE
34
FARMLAND AND THE VEGETATIVE REGION
52
INFORMATION TRANSMISSION, CONTROL DATA RECEPTION, DATA ANALYSIS DEVICE
48
TERTIARY FRESH-WATER STORAGE FACILITY

FRESHWATER SUPPLY SYSTEM

BACKGROUND OF THE INVENTION

The present invention relates to a system for freshwater transportation and freshwater supply with the use of oil tankers, or the like.

Currently, the number of oil tankers sailing throughout the world is said to amount to approximately 4,000. Unlike freight ships, oil tankers (referred below to as ships) unload crude oil on buying countries and then return to petroleum producing countries while being empty. In this case, there is a fear that when ships are lightweight, hulls are bad balanced and safe sailing cannot be expected. Hereupon, in order to make hulls stable, ballast water (generally, sea water in crude oil buying countries is loaded and after returned to petroleum producing countries, the sea water is discarded) is loaded and ships return to ports.

However, marine pollution causes a serious problem over the world in recent years, and it is inevitable that a possible international treaty will inhibit sea water loaded as ballast water from being discarded unless being purified. Accordingly, there is a high possibility that ships cannot sail in the future unless they are provided with purifying apparatuses.

By the way, drinking water, to say nothing of agricultural water, industrial water, is short in petroleum producing countries, in which oil is drilled and supplied to the world. This is because the climate in petroleum producing countries is generally semi-dry or dry.

Hereupon, such petroleum producing countries manufacture fresh water by desalting sea water since natural water cannot meet the demand. In the present circumstances, the demand for water exceeds quantities of desalted water manufactured in these countries, and desalting is high in cost, so that it is not possible to readily increase production.

Incidentally, cost for desalting on land approximately amounts to 3.09 dollar/4550 liters (81.5 yen/ton: at the conversion rate of 120 yen to the dollar).

Cost for marine treatment approximately amounts to 1.59 dollar/4550 liters (41.9 yen/ton: at the conversion rate of 120 yen to the dollar).

In particular, the cost on land is as high as 81.5 yen/ton, and too expensive to be used for agricultural water and industrial water.

Accordingly, how inexpensively fresh water is supplied is an important problem.

Conventional techniques to solve the problem are disclosed in, for example, JP-A-51-143283 and JP-A-60-209382.

JP-A-51-143283 discloses a method of purifying treatment of fresh water loaded on a ship with the use of a purifying apparatus loaded on the ship, or of floatation separation of pollutant in fresh water after unloading of the fresh water and purifying treatment in a filtering apparatus.

JP-A-60-209382 discloses measures for accommodating plastic bags, which receive therein fresh water, in a hold to transport the same.

According to the disclosure of JP-A-51-143283 and JP-A-60-209382, purifying apparatuses and plastic bags are needed, which is very high in cost.

Hereupon, it is conceivable to load domestic wasted water, which is generated in crude oil buying countries, as ballast water to use the same as drinking water and agricultural water in petroleum producing countries.

Since the domestic wasted water (so-called foul water) contains a large amount of organic matter such as nitrogen and phosphorus, the water is drained to rivers and the sea after it is subjected to purifying treatment, in which nitrogen and phosphorus are reduced to predetermined reference values.

In this manner, there is a problem that purifying treatment for removal of nitrogen and phosphorus is costly in the present circumstances.

Incidentally, while it is found that nitrogen and phosphorus is effective for agricultural fertilizer, use thereof as organic resources is given up in Europe and Japan and so they are drained to rivers and the sea in the present circumstances because a large amount of food is imported from abroad.

Further, while organic fertilizer can be formed from sludge, which contains much organic matter such as nitrogen and phosphorus, sludge is subjected to incineration, in which expensive fuel is consumed, in the present circumstances because farmland having been used since old times has already retained organic matter, etc. adequately.

That is, sewage or sludge, which is effective for fertilizer, is made little use of.

It is an object of the invention to provide a freshwater supply system capable of making effective use of domestic wasted water, which has been drained as sewage to rivers or the sea.

BRIEF SUMMARY OF THE INVENTION

The above-described object is attained by a freshwater supply system that stores fresh water transported by transport ships in storage means and takes out the fresh water from the freshwater storage means at need to use the same, wherein bacteria removal means removes bacteria from a part of the fresh water, and the part of the fresh water and that fresh water, from which bacteria have not been removed by the bacteria removal means, are separately supplied to locations, in which fresh water is needed, by water supply means.

The above-described object is attained by a freshwater supply system that stores fresh water transported by transport ships in storage means and takes out the fresh water from the freshwater storage means at need to use the same, the system comprising management means that puts management information together and sends and receives various information of countries for demand of the fresh water, analysis information of the fresh water, and various information of transportation means for transportation of the fresh water to the countries, wherein magnitudes of movements, prices, origins of movement, and destinations of movement of the fresh water are decided from the information from the management means.

The above-described object is attained by a freshwater supply system that stores fresh water transported by transport ships in storage means and takes out the fresh water from the freshwater storage means at need to use the same, the system comprising a plurality of freshwater storage means, water supply and drainage means that connects the plurality of freshwater storage means mutually, freshwater stock detection means provided in the freshwater storage means, and traffic volume control means that operates on the basis of data from the freshwater stock detection means, wherein the water supply and drainage means controls traffic volumes of fresh water between the plurality of freshwater storage means.

The above-described object is attained by a freshwater supply system that stores fresh water transported by transport ships in storage means and takes out the fresh water from the freshwater storage means at need to use the same, the system comprising a plurality of freshwater storage means, freshwater transportation means that connects the plurality of freshwater storage means mutually, estimation means for amounts of fresh water consumed on sides, to which fresh water is supplied from the respective freshwater storage means, and traffic volume control means that operates on the basis of data from the freshwater consumed amount estimation means, wherein the freshwater transportation means controls traffic volumes of fresh water among the plurality of freshwater storage means.

The above-described object is attained by the above-described freshwater supply system, wherein data of the freshwater consumed amount estimation means on sides supplied with water from the respective freshwater storage means include future weather prediction data, which include data in the past and in present, in territories supplied with water.

The above-described object is attained by the above-described freshwater supply system, wherein data of the freshwater consumed amount estimation means on sides supplied with fresh water from the respective freshwater storage means include data of growth process of plant supplied with water, and picture data representative of growth state.

The above-described object is attained by a freshwater supply system that stores fresh water transported to a plurality of land territories by a transport ship in storage means and takes out the fresh water from the freshwater storage means at need to use the same, wherein transport destination instruction means of the transport ship that instructs transport destinations of the transport ship having the fresh water to the land territories controls traffic volumes on the basis of data from freshwater stock detection means provided in the freshwater storage means in land territories.

The above-described object is attained by the above-described freshwater supply system, further comprising management means that connects together, in Internet, at least one information of data of the freshwater stock detection means, weather prediction data, data of plant growth process, data of freshwater consumed amount estimation means, data of freshwater quality detection means, data of prices of received fresh water, and data of destination instruction means, and manages procurement, arrangement, and distribution of the information.

The above-described object is attained by a freshwater supply system that transports fresh water supplied from a plurality of water sources by a transport ship to store the same in storage means and takes out the fresh water from the freshwater storage means at need to use the same, wherein destination instruction means instructs destinations, toward which the transport ship transporting the fresh water should sail, on the basis of data from detection means that detects volumes and qualities of fresh water of the water sources.

The above-described object is attained by a freshwater supply system that transports fresh water supplied from a plurality of water sources by a transport ship to store the same in storage means in land territories and takes out the fresh water from the freshwater storage means at need to use the same, wherein destination instruction means of the transport ship instructs destinations of water sources, toward which the transport ship transporting the fresh water should sail, on the basis of data from freshwater detection means that detects prices of received water from the fresh water in the water sources.

The above-described object is attained by a freshwater supply system that transports fresh water supplied from a plurality of water sources by a transport ship to store the same in storage means in land territories and takes out the fresh water from the freshwater storage means at need to use the same, wherein at least one information of data of the fresh water from water quality detection means, data of prices of received fresh water, information of instruction of destination, and documents of permission on freshwater receiving sides, is interconnected in Internet, buying and selling of the fresh water is concluded through information management means, and quality information of the transported fresh water is distributed to transport destinations in Internet.

The above-described object is attained by a freshwater supply system that loads fresh water as ballast water on ships having been unloaded, wherein the fresh water comprises domestic wasted water, organic fertilizer is formed from sludge, which is generated in a process of treatment of the domestic wasted water, and the organic fertilizer is transported to transport destinations of freshwater with the use of the ships.

According to the invention, it is possible to provide a freshwater supply system capable of making effective use of domestic wasted water, which has been drained as sewage to rivers or the sea.

Other objects, features and advantages of the invention will become apparent from the following description of the embodiments of the invention taken in conjunction with the accompanying drawings.

BRIEF DESCRIPTION OF THE SEVERAL VIEWS OF THE DRAWING

FIG. 3 is a view showing flow of ballast water being supplied to a ship, according to a further embodiment of the invention;

DETAILED DESCRIPTION OF THE INVENTION

An embodiment of the invention will be described below with reference to FIGS. 1A and 1B.

(First Embodiment)

Figure 1A:
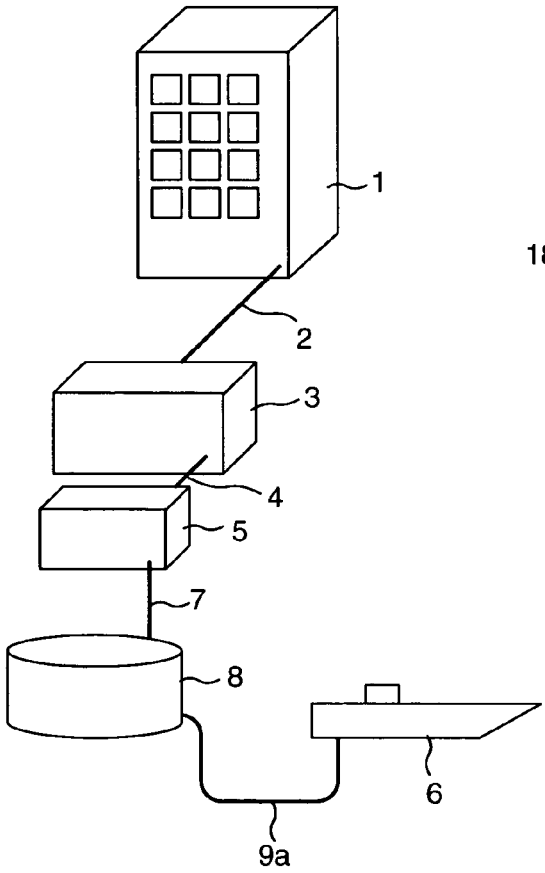
FIGS. 1A and 1B are views showing a system configuration according to an embodiment of the invention.

FIG. 1A is a view showing a system configuration, in which domestic wasted water containing a large amount of organic matter is subjected to purifying treatment, the treated fresh water is filled in a hold or a ballast water tank of a transport ship such as tanker, etc. to be transported to a dry or semi-dry territory.

Figure 1B:
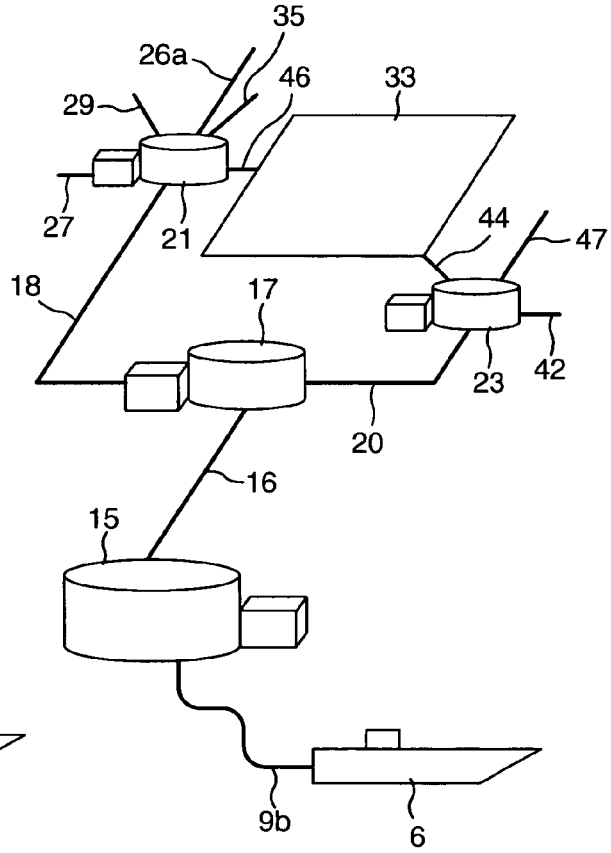

FIG. 1B is a view showing a system configuration, in which fresh water is conveyed from a transport ship to a holding tank on shore or at sea and supplied to a group of tanks in a region where fresh water is consumed.

Figure 2:
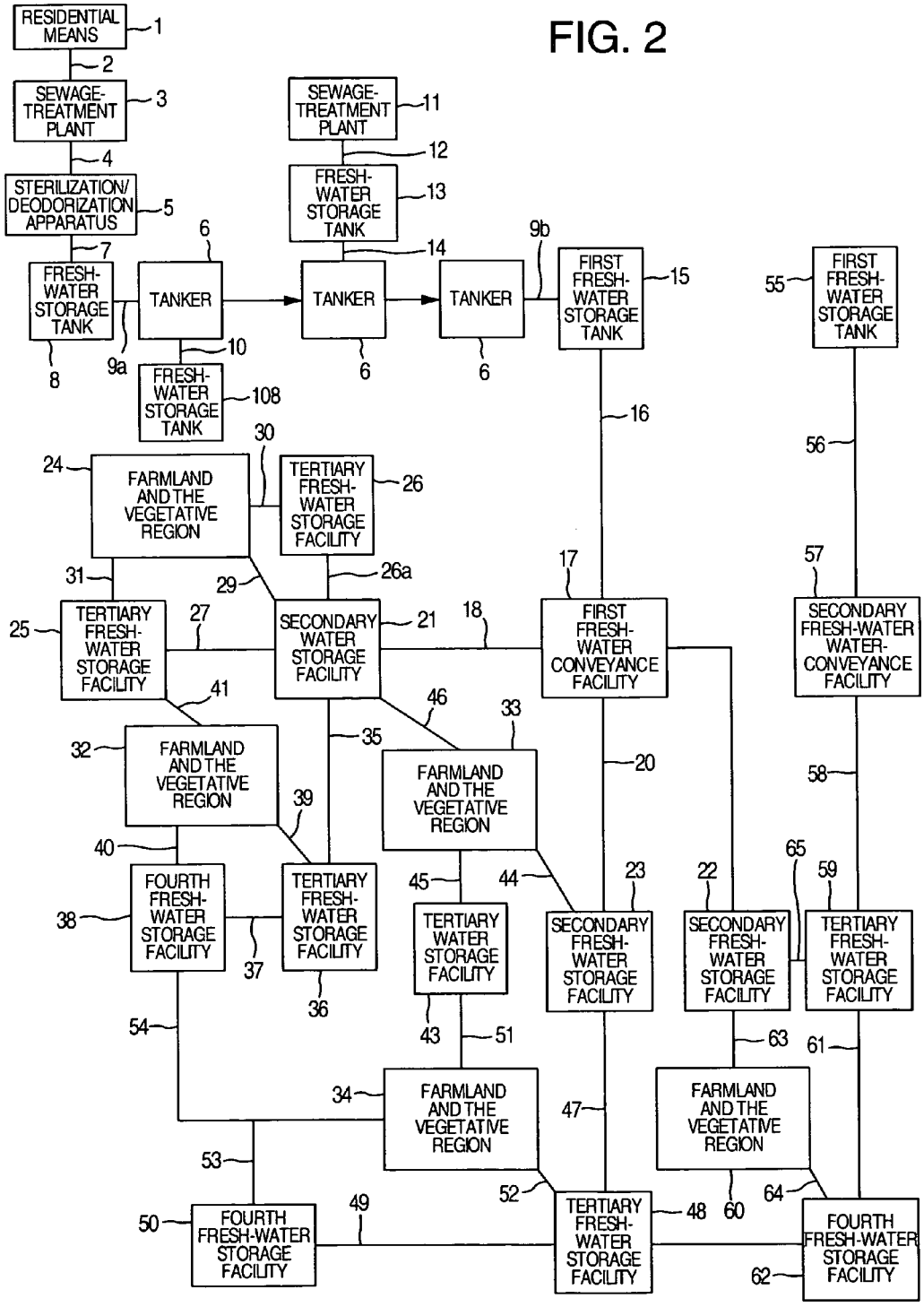
FIG. 2 is a view showing flow of ballast water being supplied to a ship, according to an embodiment of the invention.

FIG. 2 is a flowchart illustrating, in further detail, the system shown in FIGS. 1A and 1B.

Domestic wasted water discharged from residential means 1 such as apartments, etc. is conveyed through underground sewers 2, etc. to a sewage-treatment plant 3, in which plant organic matter, etc. in domestic wasted water is purified by the coagulating sedimentation system, the activated sludge method, which makes use of microorganism, etc. to be cleared of most suspended substances (SS), and substantially transparent treated water is obtained.

However, the treated water in this stage does not meet the effluent water quality standard for rivers and streams in Japan, for example, T-N (total nitrogen content), T-P (total phosphorus content), odor, the residual number of colon bacilli, etc.

Next, the treated water passes through a pipe 4 to have odor removed and harmful microorganism such as colon bacilli, bacilli sterilized by a sterilization/deodorization apparatus 5, which houses an ozone generator, an ultraviolet ray generator, a plasma generator, an activated charcoal absorption agent, an acidic water generator with electrolysis, etc. and is stored in a treated water tank in the apparatus. Accordingly, the final treated water is fresh water, of which T-N and T-P do not meet the effluent water quality standard, and is eutrophic fresh water.

The eutrophic fresh water passes through a ground or underground pipe 7 to be conveyed to a freshwater storage tank 8 on the shore, which affords supply to a ship. Conveyance of the eutrophic fresh water to the freshwater storage tank 8 may be performed by means of tank lorries. Also, a part of the pipe 7 may extend on a riverbed or sea floor, and the storage tank 8 may be fixed to a river zone or a sea zone or mounted to float thereon.

A ship that needs ballast water, for example, a tanker 6, from which crude oil is unloaded, is supplied with the eutrophic fresh water from the freshwater storage tank 8 via a pipe 9*a*.

Also, the tanker 6 can receive the eutrophic fresh water from a freshwater storage tank 108 on another spot via a pipe 10.

Also, eutrophic fresh water generated from a sewage-treatment plant 11 in a foreign country may pass through a ground or underground pipe 12 to be conveyed to a freshwater storage tank 13 on the shore, which affords supply to a ship. A tanker 6, in which ballast water can be further filled, is supplied with the eutrophic fresh water from the freshwater storage tank 13 via a pipe 14.

The tanker 6 sails to a crude-oil supply territory to discharge eutrophic fresh water, which is filled as ballast water, to a tank installed on shore or at sea, or a first freshwater storage tank 15, which is a tank of a ship for reception of ballast-water, through a pipe 9*b*, and then the tanker 6 moves to a crude-oil supply territory to load crude oil fully.

The eutrophic fresh water in the first freshwater storage tank 15 is fed to a first freshwater conveyance facility 17, which has pumps as water conveyance means, via a pipe 16, and then is conveyed via pipes 18, 19, 20 from there to secondary freshwater storage facilities 21, 22, 23 present in farmlands or vegetative regions 24, 33, 60. An amount being conveyed is regulated according to water levels in tanks in the secondary freshwater storage facilities 21, 22, 23 and the use plan of fresh water.

The eutrophic fresh water from the secondary water storage facility 21 is distributed through through pipes 26*a*, 27 to tertiary freshwater storage facilities 25, 26 arranged around the farmland or the vegetative region 24. In the case where the farmland or the vegetative region 24 is vast, the farmland or the vegetative region 24 receives the eutrophic fresh water from both the secondary water storage facility 21 via a pipe 29 and from the tertiary freshwater storage facilities 25, 26 via pipes 30, 31.

Likewise, the eutrophic fresh water transported as ballast water is also distributed to a farmland or a vegetative region 32. The eutrophic fresh water is distributed also to the farmland or the vegetative region 32 from the tertiary freshwater storage facility 25 through a pipe 41, a tertiary freshwater storage facility 36 through a pipe 39 and from a fourth freshwater storage facility 38 through a pipe 40, to which the eutrophic fresh water is distributed from the tertiary freshwater storage facility 36 through a pipe 37.

The eutrophic fresh water is distributed to the farmland or the vegetative region 33 from the secondary water storage facility 21 through a pipe 46, the secondary freshwater storage facility 23 through a pipe 44 and a tertiary water storage facility 43 through a pipe 45, to which the eutrophic fresh water is distributed via a pipe 42 from the secondary freshwater storage facility 23.

The eutrophic fresh water is distributed to a farmland or a vegetative region 34 from the tertiary water storage facility 43 through a pipe 51, a tertiary freshwater storage facility 48 through a pipe 52, to which the eutrophic fresh water is distributed via a pipe 47 from the secondary freshwater storage facility 23, a fourth freshwater storage facility 50 through a pipe 53, to which the eutrophic fresh water is distributed via a pipe 49 from the tertiary freshwater storage facility 48 and the fourth freshwater storage facility 38 through a pipe 54.

The eutrophic fresh water is distributed to the farmland or the vegetative region 60 via a pipe 63 from the secondary freshwater storage facility 22.

Further, the eutrophic fresh water passes through a secondary freshwater water-conveyance facility 57, which has pumps as water conveyance means, via a pipe 56 from a first freshwater storage tank 55, which receives eutrophic fresh water transported as ballast water from other tankers 6, and is conveyed to a tertiary freshwater storage facility 59 via a pipe 58.

The eutrophic fresh water is distributed to the farmland or the vegetative region 60 through a fourth freshwater storage facility 62 via a pipe 64 from a tertiary freshwater storage facility 59.

Further, the eutrophic fresh water is moved via a pipe 65 between the secondary freshwater storage facility 22 and the tertiary freshwater storage facility 59.

In this manner, according to the embodiment, eutrophic fresh water transported as ballast water for ships through a network of storage facilities is sufficiently distributed to an extended desert, water short farmland in desert, and vegetative regions, so that it is possible to raise vegetables and fruit trees in farmland and vegetative regions to rear agriculture.

Further, afforestation enables raising flowers and pasture grass, and breeding livestock such as cattle, goat, etc. to supply meat to outside regions being supplied.

Also, while the embodiment has been described with respect to a system that supplies water to farmlands or vegetative regions, the same effect is produced in a system that supplies water to industrial districts or residential areas, which are regions for water distribution in place of farmlands or vegetative regions. That is, the same freshwater supply system is used to enable supplying cheap fresh water to water distribution facilities that supply industrial water and sprinkle water to industrial districts or residential areas. Also, it is possible in residential areas to use eutrophic fresh water as raw water for manufacture of drinking water.

The embodiment produces an advantageous effect that even if nitrogen and phosphorus remain much, treated domestic wasted water, which is odorless, of which harmful microorganism such as colon bacilli, bacilli are sterilized, and which is inexpensive and safe for the human body, can be filled as ballast water in ships such as oil tankers, etc., and provided and distributed as agricultural water to extended farmlands or vegetative regions in dry or semi-dry territories at a cheap transport cost, and can be inexpensively provided and distributed as industrial water and sprinkle water to industrial districts or residential areas of high consumption demand for water.

Further, ballast water is loaded on ships, which are to be filled with the ballast water, in a location where the ballast water is filled, and organic fertilizer manufactured from sludge generated from treatment of domestic wasted water can be unloaded in a destination, to which ballast water is transported, and sold to be used as organic fertilizer in farmlands or vegetative regions.

Accordingly, the embodiment produces an advantageous effect that it is possible to reduce expenses for treatment of domestic wasted water on a side of a freshwater supply country and to effectively reduce organic fertilizer to agricultural land and an advantageous effect that by transporting eutrophic fresh water and organic fertilizer abroad, organic matter is reduced in organic fertilizer production countries and discharge of organic compound to the environment is reduced to prevent eutrophication of environmental water to purify the environment.

Further, according to the invention, since ballast water is not discharged to the sea, which is outside ballast-water purification regulations, it is not necessary to install any purifying facility in ships, so that it is possible in the future to expect an effect that cost for installation of purifying facilities and cost for operation of purifying facilities are made unnecessary to enable reducing cost for sailing of ships.

A further embodiment of the invention will be described with reference to FIGS. 3 and 4.

Figure 4:
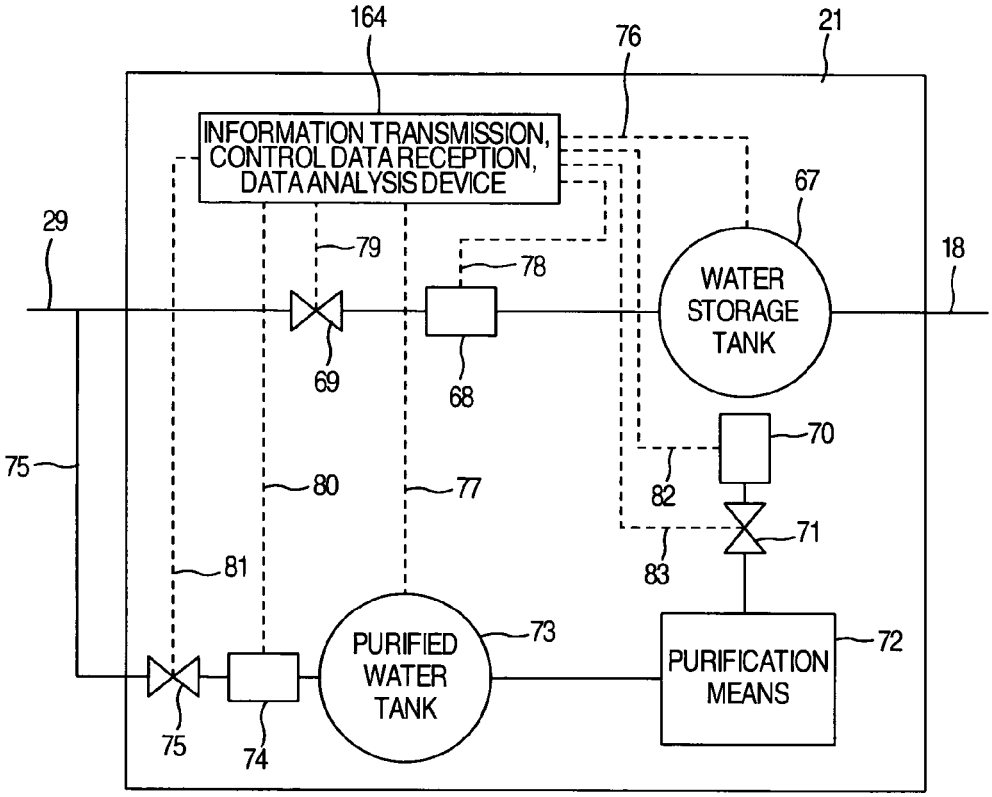
FIG. 4 is a view showing purification flow of ballast water according to the further embodiment of the invention.

A difference between the system shown in FIGS. 3 and 4 and the system shown in FIGS. 1 and 2 resides in a system for management of distribution of unloaded fresh water, amount of fresh water to be stored, amount of distribution, and quality of water as distributed, and in particular, the provision of a method of furnishing fresh water inexpensively. Further, the difference resides in that a supply system provides a system for management of delivery amount and quality of water as distributed to deliver fresh water to dry or semi-dry territories, farmland of high consumption demand for agricultural water, industrial installation, and drinking water treatment facilities.

FIG. 3 shows a part of the water distribution system shown in FIG. 1.

The eutrophic fresh water in the first freshwater storage tank 15 passes through the first freshwater conveyance facility 17, which has pumps as water conveyance means, via the pipe 16, and is conveyed via the pipes 18, 19, 20 from there to the secondary freshwater storage facilities 21, 22, 23 and further to the tertiary freshwater storage facilities 25, 26, 36, 43, 48 to be distributed to the farmland or the vegetative regions 24, 32, 33, 34, 60.

Amounts being conveyed to tanks in the secondary freshwater storage facilities 21, 22, 23 from the first freshwater storage tank 15 are regulated according to water levels in freshwater tanks in the respective secondary freshwater storage facilities and the use plan of fresh water.

Hygrometers and thermometers in farmlands or vegetative regions, data information of harvest raising picture data required for raising harvest, etc. and information of water levels, amounts of fresh water to be stored, and quality of fresh water in freshwater tanks of first freshwater storage tanks, second freshwater storage tanks are measured. The information as measured is transmitted by radio or wired communication to an information transmission, data analysis devices, a water management control analysis, control data transmission device 166 of a data integrated control facility 165 from an information transmission device 163 and an information transmission, control data reception, data analysis device 164.

In the data integrated control facility 165, amounts of sprinkling water in farmland, time zone of sprinkling, quality of sprinkling water, and amounts of water being delivered to water storage facilities are subjected to numerical analysis from those humidity and temperature in farmland, harvest raising picture data, and future weather prediction data including data in the past and at present, which are received, and a computer is used to determine a control method and control values.

The necessary data are respectively transmitted by radio or wired communication to the information transmission, control data reception, data analysis devices 164 in the first freshwater storage tanks and the secondary freshwater storage facilities, and conveying pumps and flow control valves in the secondary freshwater storage facilities control amounts of water being conveyed to the secondary freshwater storage facilities from the first freshwater storage tanks, and amounts of water being conveyed to respective farmlands from the secondary freshwater storage facilities.

Qualities of water being conveyed to respective farmlands are determined according to growing states of harvest. For example, since a problem is caused when pathogenic bacteria are mixed in fresh water for crop at time just before a harvest time, fresh water further purified is supplied.

Referring to FIG. 4, fresh water is supplied via the pipe 18 to the secondary freshwater storage facility 21 from the first freshwater storage facility 17 (shown in FIG. 3) to be stored in a water storage tank 67. Ordinarily, fresh water in the water storage tank 67 is pressurized by a pump 68 with the quality remained, and controlled in flow rate by a flow control valve 69 to be distributed via the pipe 29 to the farmland or the vegetative region 24 (shown in FIG. 2).

On the other hand, in the case where fresh water is to be purified in high quality, fresh water in the water storage tank 67 is pressurized by a pump 70 to be controlled in flow rate by a regulating valve 71 and conveyed to purification means 72. The purification means 72 comprises an ultraviolet sterilizing apparatus, an ozone sterilizing apparatus, and a membrane filtrating apparatus, and pathogenic bacteria in the treated fresh water are sterilized, removed so that the fresh water is purified.

The purified fresh water is stored in a purified water tank 73. The purified fresh water in the purified water tank 73 is pressurized by a pump 74 to be controlled in flow rate by a flow control valve 75 to be distributed via the pipe 29 to the farmland or the vegetative region 24 (shown in FIG. 3). Information of water level of the fresh water in the water storage tank 67 and of water level and water quality in the purified water tank 73 is transmitted via data wiring 76, 77 to the information transmission, control data reception, data analysis device 164.

Amounts of fresh water being conveyed are controlled by controlling the operation of the pump 68 and the valve opening degree of the flow control valve 69 through control wiring 78, 79. Amounts of purified fresh water being conveyed are controlled by controlling the operation of the pump 74 and the valve opening degree of the flow control valve 75 through control wiring 80, 81. Further, an amount of fresh water being conveyed to the purification means 72 from the water storage tank 67 is controlled by controlling the operation of the pump 70 and the valve opening degree of the flow control valve 71 through control wiring 82, 83.

According to the embodiment, in the case where fresh water, of which bacteria such as colon bacilli, etc. being harmful to the human body are removed or sterilized, is supplied as sprinkling water to harvest in the farmland or the vegetative region 24 at a harvest time, the information transmission, control data reception, data analysis device 164 receives a command from the data integrated control facility 165 (shown in FIG. 3) to control the pumps and the flow control valves.

The purified fresh water being distributed is sprinkled on vegetables, such as cabbage, etc. until crop, and vegetables can be harvested in a safe state. However, not a little cost is necessary in purifying treatment.

Since fresh water for sprinkling can be purified only at time before crop on the basis of harvest raising picture data, the cost for treatment in the embodiment can be restricted to a minimum by purifying an amount of necessity minimum.

(Third Embodiment)

Figure 5:
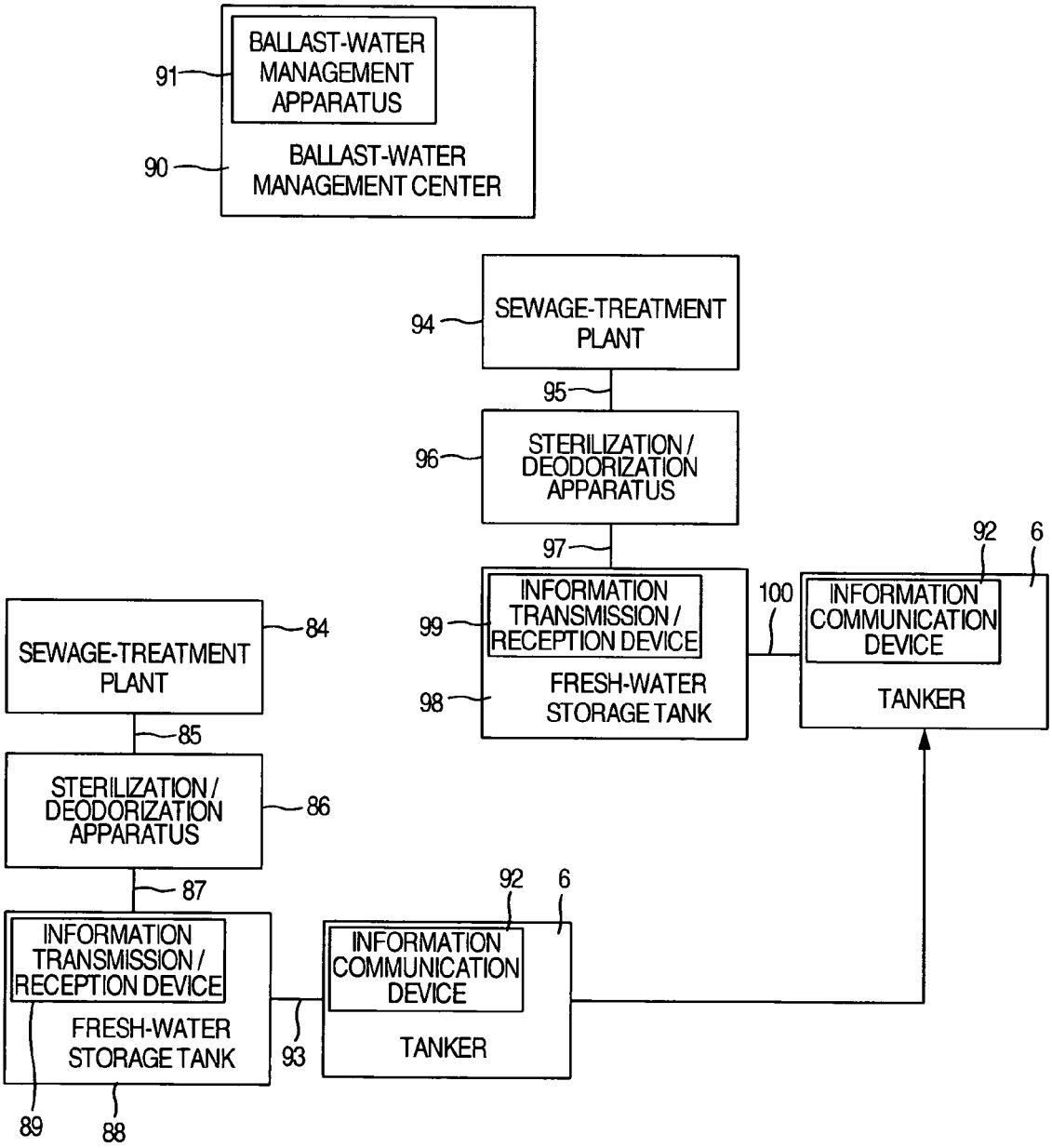
FIG. 5 is a view showing flow in a ballast-water supply management system according to a still further embodiment of the invention.

FIG. 5 shows a still further embodiment.

FIG. 5 is a flow diagram of a system according to the still further embodiment of the invention.

A difference between the embodiment shown in FIG. 5 and the embodiment shown in FIGS. 1 and 2 concerns filling of fresh water containing domestic wasted water in ships and resides in constructing a ballast-water management system that can ensure supply locations of fresh water throughout the world and control where oceangoing ships can be filled with ballast water in a most inexpensive operation and in a shortest time.

That is, the ballast-water management system makes it possible to fill ballast water, which is fresh water, in an A country, receive information of fresh water stock in a B country in the case where an amount of fresh water in the A country is short of a necessary amount, and fill fresh water corresponding to shortage, as ballast water, in the B country on the basis of the information. Further, with the ballast-water management system, it is possible to fill ballast water, which is sea water, in the A country, discharge the ballast water, which is sea water, in the B country, and fill fresh water, which is treated water composed of domestic wasted water, in the B country, in which supply is cheaper than that in the A country. Further, it is possible to fill cheap fresh water conformed to an allowable water quality in a destination of supply of ballast water on the basis of information with respect to water quality of treated water composed of domestic wasted water.

Referring to FIG. 5, in the A country, eutrophic fresh water having been treated in a sewage-treatment plant 84, in which domestic wasted water containing a large amount of organic matter is purified, passes via a pipe 85 through a sterilization/deodorization apparatus 86, which houses an ozone generator, an ultraviolet ray generator, a plasma generator, an activated charcoal absorption agent, an acidic water generator with electrolysis, etc., and is conveyed via a pipe 87 to a freshwater storage tank 88 on the shore, which affords supply to ships. Data of stock and water quality in the freshwater storage tank 88 are concentratedly transmitted by radio, wired communication, or Internet to a ballast-water management apparatus 91 in a ballast-water management center 90, which includes a ballast-water management system, from an information transmission/reception device 89.

Further, when the tanker 6 inputs a required amount of ballast water and information of a transport destination into the ballast-water management apparatus 91 of the ballast-water management center 90 through an information communication device 92, a supply location of ballast water and an amount being filled are calculated and controlled on the basis of information of ballast water and water quality in respective countries, in which ballast water is stocked, and the ballast-water management apparatus 91 of the ballast-water management center 90 transmits and instructs a demand for a destination to touch and stay, an amount being filled, unit cost of ballast water, and date and hour of filling, to the information communication device 92 of the tanker 6.

A name of a tanker to touch and stay, an amount being supplied and filled, and date and hour of filling are transmitted and instructed to the information transmission/reception device 89 of the freshwater storage tank 88. A destination, to which fresh water being transported is supplied, water quality, and date and hour of filling are transmitted and instructed via Internet or the like to a freshwater receiving facility being a transport destination, and information of permission of receipt is received by the ballast-water management apparatus 91 of the ballast-water management center 90, on the basis of results of which the tanker 6 transmits a required amount of ballast water to the information communication device 92.

In the B country, eutrophic fresh water having been treated in a sewage-treatment plant 94, in which domestic wasted water containing a large amount of organic matter is purified, passes via a pipe 95 through a sterilization/deodorization apparatus 96, which houses an ozone generator, an ultraviolet ray generator, a plasma generator, an activated charcoal absorption agent, an acidic water generator with electrolysis, etc., and is conveyed via a pipe 97 to a freshwater storage tank 98 on the shore, which affords supply to ships. Data of stock and water quality in the freshwater storage tank 98 are concentratedly transmitted by radio, wired communication, or Internet to the ballast-water management apparatus 91 in the ballast-water management center 90, which includes a ballast-water management system, from an information transmission/reception device 99.

For example, in accordance with an instruction from the ballast-water management center 90, the tanker 6 is filled with fresh water as a part of ballast water, an amount of which enables safe sailing, via a pipe 93 from the freshwater storage tank 88 in the A country, and then sails to the B country in accordance with an instruction from the ballast-water management center 90 to be filled with a required amount of fresh water via a pipe 100 from the freshwater storage tank 98 in the B country.

Then, the tanker sails to a transport destination country, from which permission for distribution of ballast water is obtained, and sells and distributes fresh water to the transport destination country. The tanker is filled with sea water as ballast water in the transport destination country, and sails to a sea area, in which crude oil is received, to discharge ballast water and receive crude oil inboard. The ballast-water management center manages volume of transactions of fresh water and transaction expenses collectively, and performs management of water quality information of ballast water and pay analysis service of water quality of ballast water, and the ballast-water management center receives, as service charge, managing expense of information and a part of fee of trading.

According to the embodiment, since amounts and water qualities of domestic wasted water can be collectively managed throughout the world, information of filling locations capable of supplying ballast water can be offered to ships, which need fresh water as ballast water, and information of water quality is beforehand communicated to a country, to which ballast water is to be supplied, so that permission for receipt of ballast water based on the water quality standard in that country, to which ballast water is to be supplied, can be communicated to the ship.

Accordingly, when ballast water is filled in a ship, an owner of the ship can get permission for receipt of ballast water, so that a request for permission is not necessary on a side of the ship and it is not necessary to perform any office routine for transportation of ballast water, thus enabling achieving a decrease in business expense.

Further, according to the embodiment, it is possible to fill fresh water on the basis of data of freshwater stock detection means, communicate a transport destination of a transport ship to the transport ship in accordance with an instruction from the ballast-water management center 90, and get permission for receipt at the transport destination from the ballast-water management center 90, so that there is produced an advantageous effect that even when a transport destination is urgently changed, such change can be quickly accommodated for.

As described above, according to the invention, not only present returning tankers are increased in use value but also a demand for water in, for example, dry territories along the Bay of Arabia is met. Also, there is provided a method, by which expenses for treatment of domestic wasted water on a side of freshwater supply countries are reduced, and organic fertilizer is effectively reduced to farmland.

Since present returning tankers can get information of locations, in which ballast water is filled, and information of permission for receipt of ballast water through communication means such as Internet or the like, it is possible to efficiently carry out transportation of ballast water.

While the invention has been described in association with application of treated water of domestic wasted water as fresh water, the same advantageous effect is produced even when fresh water comprises inexpensive river water and lake water.

In particular, the same effect is produced even in the case where ballast water being sea water conveyed from a foreign country is discharged to a sea area in that country, which is somewhere while the ship sails, and which has not ratified an international treaty for ballast-water quality control, inexpensive river water, or lake water is instead filled as ballast water in the country, and the fresh water is transported to dry territories.

Further, while the invention has been described in association with conveyance of fresh water as ballast water for ships, the same effect is produced with respect to an integrated control system for giving and receiving, supply and delivery of fresh water also in the case where fresh water is filled in plastic bags and the plastic bags are towed and conveyed by ships.

The invention produces an effect that even if T-N and T-P remain much, treated domestic wasted water, which is odorless, of which harmful microorganism such as colon bacilli, bacilli are sterilized, and which is inexpensive and safe for the human body, can be filled as ballast water in ships such as oil tankers, etc., and transported at a cheap transport cost, so that inexpensive fresh water can be provided and distributed as agricultural water to extended farmland or vegetative regions in dry or semi-dry territories.

Also, ballast water is loaded on ships in a location where the ballast water is filled, and organic fertilizer manufactured from sludge generated from treatment of domestic wasted water can be unloaded in a destination, to which ballast water is transported, and sold to be used as organic fertilizer in farmlands or vegetative regions. Accordingly, the embodiment produces an effect that it is possible to reduce expenses for treatment of domestic wasted water on a side of a freshwater supply country and to effectively reduce organic fertilizer to agricultural land and an effect that by transporting eutrophic fresh water and organic fertilizer abroad, organic matter is reduced in organic fertilizer production countries and discharge of organic compound to the environment is reduced to prevent eutrophication of environmental water to purify the environment.

According to the embodiment, since amounts and water qualities of domestic wasted water can be collectively managed throughout the world, information of filling locations capable of supplying ballast water can be offered to ships, which need fresh water as ballast water, and information of water quality is beforehand communicated to a country, to which ballast water is to be supplied, so that information of permission for receipt of ballast water based on the water quality standard of that country, to which ballast water is to be supplied, can be communicated to the ship. Accordingly, when ballast water is filled in a ship, an owner of the ship can get permission for receipt of ballast water, so that a request for permission is not necessary on a side of the ship and it is not necessary to perform any office routine for transportation of ballast water, thus enabling achieving a decrease in business expense.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A freshwater supply system that stores fresh water transported by transport ships in storage means and takes out the fresh water from the freshwater storage means at need to use the same, the system comprising a plurality of freshwater storage means, freshwater transportation means that connects the plurality of freshwater storage means mutually, estimation means for amounts of fresh water consumed on sites to which fresh water is supplied from the respective freshwater storage means, and traffic volume control means that operates on the basis of data from the freshwater consumed amount estimation means, wherein the freshwater transportation means controls traffic volumes of fresh water among the plurality of freshwater storage means wherein data of the freshwater consumed amount estimation means on sites supplied with water from the respective freshwater storage means include future weather prediction data, which include data in the past and in present, in territories supplied with water.

2. A freshwater supply system, that stores fresh water transported by transport ships in storage means and takes out the fresh water from the freshwater storage means at need to use the same, the system comprising a plurality of freshwater storage means, freshwater transportation means that connects the plurality of freshwater storage means mutually, estimation means for amounts of fresh water consumed on sites to which fresh water is supplied from the respective freshwater storage means, and traffic volume control means that operates on the basis of data from the freshwater consumed amount estimation means, wherein the freshwater transportation means controls traffic volumes of fresh water among the plurality of freshwater storage means wherein data of the freshwater consumed amount estimation means on sites supplied with fresh water from the respective freshwater storage means include data of growth process of plant supplied with water, and picture data representative of growth state.

3. A freshwater supply system that stores fresh water transported to a plurality of land territories by a transport ship in storage means and takes out the fresh water from the freshwater storage means at need to use the same, wherein transport destination instruction means of the transport ship that instructs transport destinations of the transport ship having the fresh water to the land territories controls traffic volumes on the basis of data from freshwater stock detection means provided in the freshwater storage means in land territories.

4. The freshwater supply system according to claim 3, further comprising management means that connects together, in Internet, at least one information of data of the freshwater stock detection means, weather prediction data, data of plant growth process, data of freshwater consumed amount estimation means, data of freshwater quality detection means, data of prices of received fresh water, and data of destination instruction means, and manages procurement, arrangement, and distribution of the information.

5. A freshwater supply system that transports fresh water supplied from a plurality of water sources by a transport ship to store the same in storage means and takes out the fresh water from the freshwater storage means at need to use the same, wherein destination instruction means instructs destinations, toward which the transport ship transporting the fresh water should sail, on the basis of data from detection means that detects volumes and qualities of fresh water of the water sources.

6. A freshwater supply system that transports fresh water supplied from a plurality of water sources by a transport ship to store the same in storage means in land territories and takes out the fresh water from the freshwater storage means at need to use the same, wherein destination instruction means of the transport ship instructs destinations of water sources, toward which the transport ship transporting the fresh water should sail, on the basis of data from freshwater detection means that detects prices of received water from the fresh water in the water sources.

7. A freshwater supply system that transports fresh water supplied from a plurality of water sources by a transport ship to store the same in storage means in land territories and takes out the fresh water from the freshwater storage means at need to use the same, wherein at least one information of data of the fresh water from water quality detection means, data of prices of received fresh water, information of instruction of destination, and documents of permission on freshwater receiving sides, is interconnected in Internet, buying and selling of the fresh water is concluded through information management means, and quality information of the transported fresh water is distributed to transport destinations in Internet.

8. A freshwater supply system that loads fresh water as ballast water on ships having been unloaded, wherein the fresh water comprises domestic wasted water, organic fertilizer is formed from sludge, which is generated in a process of treatment of the domestic wasted water, and the organic fertilizer is transported to transport destinations of freshwater with the use of the ships.

9. A freshwater supply system that stores fresh water transported by transport ships in storage means and takes out the fresh water from the freshwater storage means at need to use the same, the system comprising management means that puts management information together and sends and receives various information of countries for demand of the fresh water, analysis information of the fresh water, and various information of transportation means for transportation of the fresh water to the countries, wherein magnitudes of movements, prices, origins of movement, and destinations of movement of the fresh water are decided from the information from the management means.

* * * * *